US011589688B2

(12) United States Patent
Rodriguez et al.

(10) Patent No.: US 11,589,688 B2
(45) Date of Patent: Feb. 28, 2023

(54) SYSTEM TO SUPPORT CANTILEVERED MEMBERS FROM A VERTICAL PANEL

(71) Applicant: QUALSERV SOLUTIONS, LLC, Fort Smith, AR (US)

(72) Inventors: Arturo Gonzalez Rodriguez, Lilburn, GA (US); Michael D. Potter, Fort Smith, AR (US)

(73) Assignee: QUALSERV SOLUTIONS LLC, Fort Smith, AR (US)

( * ) Notice: Subject to any disclaimer, the term of this patent is extended or adjusted under 35 U.S.C. 154(b) by 0 days.

(21) Appl. No.: 17/582,155

(22) Filed: Jan. 24, 2022

(65) Prior Publication Data

US 2022/0142380 A1 May 12, 2022

Related U.S. Application Data

(63) Continuation of application No. 16/808,670, filed on Mar. 4, 2020, now Pat. No. 11,241,106.

(51) Int. Cl.

| | |
|---|---|
| ***A47F 5/08*** | (2006.01) |
| ***A47F 5/10*** | (2006.01) |
| ***A47B 96/06*** | (2006.01) |

(52) U.S. Cl.

CPC ..... *A47F 5/083* (2013.01); *A47B 96/068* (2013.01); *A47F 5/0815* (2013.01); *A47F 5/10* (2013.01)

(58) Field of Classification Search

CPC ..... A47F 5/083; A47F 5/0823; A47F 5/0815; A47F 5/0876; A47F 5/10; A47B 96/068

See application file for complete search history.

(56) References Cited

U.S. PATENT DOCUMENTS

| | | | |
|---|---|---|---|
| 2,271,469 | A | 1/1942 | Wilson |
| 2,303,673 | A | 12/1942 | Wilson |
| 2,516,907 | A | 8/1950 | Penfold |
| 4,405,272 | A | 9/1983 | Wollar |
| 4,697,774 | A | 10/1987 | Sarton |

(Continued)

FOREIGN PATENT DOCUMENTS

| | | |
|---|---|---|
| DE | 19832968 | 1/2000 |
| DE | 29921495 U | 5/2000 |

(Continued)

OTHER PUBLICATIONS

Search Report & Written Opinion issued in Appl. No. PCT/US2021/020601 (dated 2021).

*Primary Examiner* — Stanton L Krycinski
(74) *Attorney, Agent, or Firm* — Barnes & Thornburg LLP

(57) ABSTRACT

A system to support a member extending from a wall. The system includes a wall with one more apertures, a bracket configured to be disposed an aperture, and a member comprising a tang, wherein the tang is configured to be supported by the bracket. The bracket comprises a body with a hole, the hole receives the tang therein, wherein the body comprises a plurality of surfaces that collectively define the hole, wherein the body includes a portion biased inwardly toward the opposite surface, wherein the biased portion extends inwardly past an inner surface of the respective wall of the plurality of walls that includes the biased portion. The body further includes a plurality of fingers extend from the plurality of walls, the plurality of fingers each biased in a direction away from the hole.

28 Claims, 9 Drawing Sheets

(56) References Cited

U.S. PATENT DOCUMENTS

| | | | |
|---|---|---|---|
| 4,804,303 | A | 2/1989 | Statkus |
| 4,952,106 | A | 8/1990 | Kubogochi |
| 5,144,777 | A | 9/1992 | Fishel |
| 5,337,903 | A | 8/1994 | Wolcovitch et al. |
| 5,593,045 | A | 1/1997 | Eldon, III et al. |
| 6,085,916 | A | 7/2000 | Kovacevic |
| 6,164,448 | A | 12/2000 | Schmutz et al. |
| 6,302,369 | B1 | 10/2001 | Liebers et al. |
| 6,405,984 | B1 | 6/2002 | Simons et al. |
| 6,443,317 | B1 | 9/2002 | Brozak, Jr. |
| D469,004 | S | 1/2003 | Winig et al. |
| 6,574,924 | B2 | 6/2003 | Maniezzo |
| 6,581,788 | B1 | 6/2003 | Winig et al. |
| 6,591,762 | B1 | 7/2003 | Haghayegh |
| D478,499 | S | 8/2003 | Winig et al. |
| D478,500 | S | 8/2003 | Winig et al. |
| D478,805 | S | 8/2003 | Winig et al. |
| 6,616,479 | B1 | 9/2003 | Jones |
| D481,920 | S | 11/2003 | Winig et al. |
| D482,255 | S | 11/2003 | Winig et al. |
| D482,905 | S | 12/2003 | Peyker |
| 6,702,128 | B2 | 3/2004 | Winig et al. |
| D491,286 | S | 6/2004 | Winig et al. |
| D491,287 | S | 6/2004 | Winig et al. |
| D491,449 | S | 6/2004 | Winig et al. |
| D491,600 | S | 6/2004 | Cole |
| D494,035 | S | 8/2004 | Winig et al. |
| D494,036 | S | 8/2004 | Winig et al. |
| D494,436 | S | 8/2004 | Winig et al. |
| D494,451 | S | 8/2004 | Winig et al. |
| D494,457 | S | 8/2004 | Winig et al. |
| D495,067 | S | 8/2004 | Winig et al. |
| D495,243 | S | 8/2004 | Winig et al. |
| D495,944 | S | 9/2004 | Winig et al. |
| D496,844 | S | 10/2004 | Winig et al. |
| D497,788 | S | 11/2004 | Winig |
| D498,005 | S | 11/2004 | Winig et al. |
| D498,372 | S | 11/2004 | Winig et al. |
| D498,634 | S | 11/2004 | Winig |
| D499,195 | S | 11/2004 | Winig et al. |
| D499,626 | S | 12/2004 | Winig et al. |
| D501,125 | S | 1/2005 | Winig |
| D502,638 | S | 3/2005 | Winig |
| D508,199 | S | 8/2005 | Winig |
| 6,935,518 | B2 | 8/2005 | Winig et al. |
| D509,393 | S | 9/2005 | Winig |
| 7,131,806 | B2 | 11/2006 | Hansen |
| D538,555 | S | 3/2007 | Raile |
| D547,585 | S | 7/2007 | Netto et al. |
| 7,353,957 | B2 | 4/2008 | Winig et al. |
| 7,354,024 | B2 | 4/2008 | Winig |
| D577,940 | S | 10/2008 | Winig et al. |
| D577,941 | S | 10/2008 | Winig et al. |
| D577,942 | S | 10/2008 | Winig et al. |
| D579,705 | S | 11/2008 | Winig et al. |
| D582,175 | S | 12/2008 | Levy et al. |
| D587,943 | S | 3/2009 | Quintal |
| 7,866,492 | B2 | 1/2011 | Walter |
| 8,123,185 | B2 | 2/2012 | Winig et al. |
| 8,127,946 | B2 | 3/2012 | Winig et al. |
| 8,128,043 | B2 | 3/2012 | Walter |
| 8,186,635 | B2 | 5/2012 | DeVito |
| 8,235,223 | B2 | 8/2012 | Winig et al. |
| 8,540,198 | B2 | 9/2013 | Keyvanloo |
| 8,573,414 | B2 | 11/2013 | Winig et al. |
| 8,646,619 | B2 | 2/2014 | Winig et al. |
| 8,646,623 | B2 | 2/2014 | Winig et al. |
| 8,677,573 | B2 | 3/2014 | Lee |
| 8,695,177 | B2 | 4/2014 | Kato |
| 8,777,020 | B2 | 7/2014 | Winig et al. |
| 8,833,571 | B2 | 9/2014 | Anderson |
| 8,931,746 | B2 | 1/2015 | Fanning |
| 9,347,474 | B2 | 5/2016 | Mizukoshi |
| 9,357,859 | B2 * | 6/2016 | Fanning, Jr ..... A47F 7/0042 |
| 9,429,176 | B2 | 8/2016 | Morris |
| 9,565,933 | B2 | 2/2017 | Kasza et al. |
| 9,993,094 | B1 | 6/2018 | Franzone, Jr. et al. |
| 10,087,978 | B2 | 10/2018 | Wall |
| 2001/0002521 | A1 | 6/2001 | Maniezzo |
| 2003/0192843 | A1 | 10/2003 | Winig et al. |
| 2003/0192844 | A1 | 10/2003 | Winig et al. |
| 2004/0108287 | A1 | 6/2004 | Winig |
| 2005/0242047 | A1 | 11/2005 | Winig et al. |
| 2007/0117455 | A1 | 5/2007 | Walter |
| 2007/0215768 | A1 | 9/2007 | Winig et al. |
| 2007/0251904 | A1 | 11/2007 | Winig |
| 2009/0126482 | A1 | 5/2009 | Fundak et al. |
| 2011/0284486 | A1 | 11/2011 | Walter |
| 2012/0018388 | A1 | 1/2012 | Winig et al. |
| 2012/0187055 | A1 | 7/2012 | Winig et al. |
| 2013/0032550 | A1 | 2/2013 | Winig et al. |
| 2013/0037496 | A1 | 2/2013 | Winig et al. |
| 2014/0096575 | A1 | 4/2014 | Winig et al. |

FOREIGN PATENT DOCUMENTS

| | | |
|---|---|---|
| DE | 29902997 U | 6/2000 |
| EP | 0834274 | 4/1998 |
| EP | 1338223 | 8/2003 |
| GB | 541908 | 12/1941 |
| KR | 2005-0021636 | 3/2005 |

* cited by examiner

SYSTEM TO SUPPORT CANTILEVERED MEMBERS FROM A VERTICAL PANEL

CROSS-REFERENCE TO RELATED APPLICATIONS

This application is a continuation of U.S. Nonprovisional application Ser. No. 16/808,670, filed on Mar. 4, 2020, the entirety of which is hereby fully incorporated by reference herein.

BACKGROUND

The subject disclosure relates to display systems for items to be displayed for sale, either displayed at the point of sale or displayed as intended for order from the point of sale, or displayed for ordering from another location or interface. The system is a system to allow of convenient and efficient installation and with a pleasing look for customers at the point of sale.

BRIEF SUMMARY

A first representative embodiment of the disclosure is provided. The embodiment includes a system to support a member extending from a wall. The system includes, a wall with one or more apertures disposed therethrough and a bracket configured to be disposed within an aperture of the one or more apertures, the bracket comprising a front portion and a rear portion. A member comprising a tang and a portion that extends from the tang, wherein the tang is configured to extend within and be supported by the bracket is provided. The member may be for example, a shelf, a sign, a mirror, or the like. The bracket comprises a body with a hole disposed through a front surface of the front portion of the body, the hole receives the tang therein, the hole being formed with a length and a width just larger than a respective length and a respective width of the tang, wherein the body comprises a plurality of surfaces including opposite upper and lower surfaces, and opposite left and right surfaces that collectively define the hole, wherein at least one of the upper surface, the lower surface, the left surface, and the right surface comprises a portion biased inwardly toward the opposite surface of the plurality of walls, wherein the biased portion extends inwardly past an inner surface of the respective wall of the plurality of walls that includes the biased portion. The body further comprises a plurality of fingers extend from the plurality of walls, the plurality of fingers each biased in a direction away from the hole.

Advantages of the present disclosure will become more apparent to those skilled in the art from the following description of the preferred embodiments of the disclosure that have been shown and described by way of illustration. As will be realized, the disclosed subject matter is capable of other and different embodiments, and its details are capable of modification in various respects. Accordingly, the drawings and description are to be regarded as illustrative in nature and not as restrictive.

DETAILED DESCRIPTION OF THE PREFERRED EMBODIMENTS

Figure 1:
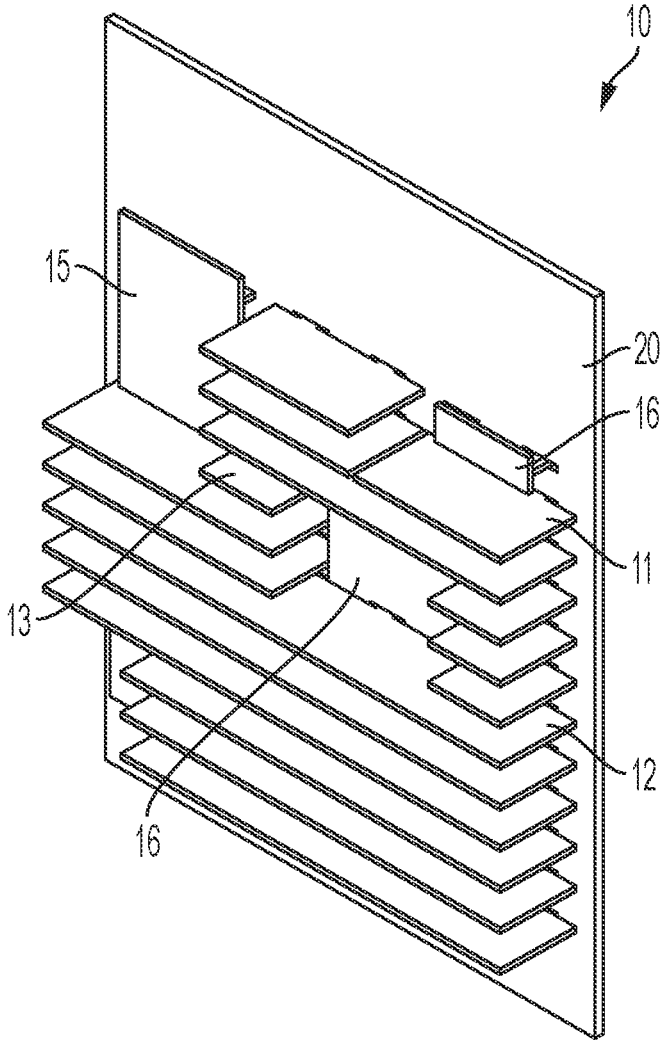
FIG. 1 is a perspective view of a system to support a plurality of cantilevered members, such as shelves, vertical panels/signs, and mirrors supported on a vertical panel.

Turning now to FIGS. 1-9, a system 10 to support a cantilevered member upon a wall is provided. The system 10 may be configured to support a plurality of cantilevered members in a geometric or other arrangement, and the system is provided to support cantilevered members that attach to the wall with a single attachment member, such a tang (e.g. 13*a*) or to simultaneously support a cantilevered member that includes multiple tangs (e.g. 12*a*). The system 10 may be adapted to support one or more shelves (11, 12, 13) that extend outwardly from the tang along the same plane as the tang or in a plane that is substantially parallel to a plane through the tang, while the system is also adapted to support one or more signs, mirrors, or the like, which are disposed perpendicular to or at an oblique angle with respect to a plane through the tang, and which are supported such that the sign, mirror, etc. is offset from a front surface 21 of the wall 20. By way of other example, the system may support other items such as point of sale coupons, visual marketing literature, audio-visual components such as televisions or computer screens, touchscreens, or other objects. The object may be supported upon the panel 20 in a cantilevered manner (i.e. extending from the panel and not contacting the panel other than via the engagement between the tang and the bracket 40/aperture 24 as discussed below) and the object may also be supported upon the panel with a portion of the object contacting the panel 20 at another position than the support between the tang and bracket/aperture.

Figure 2:
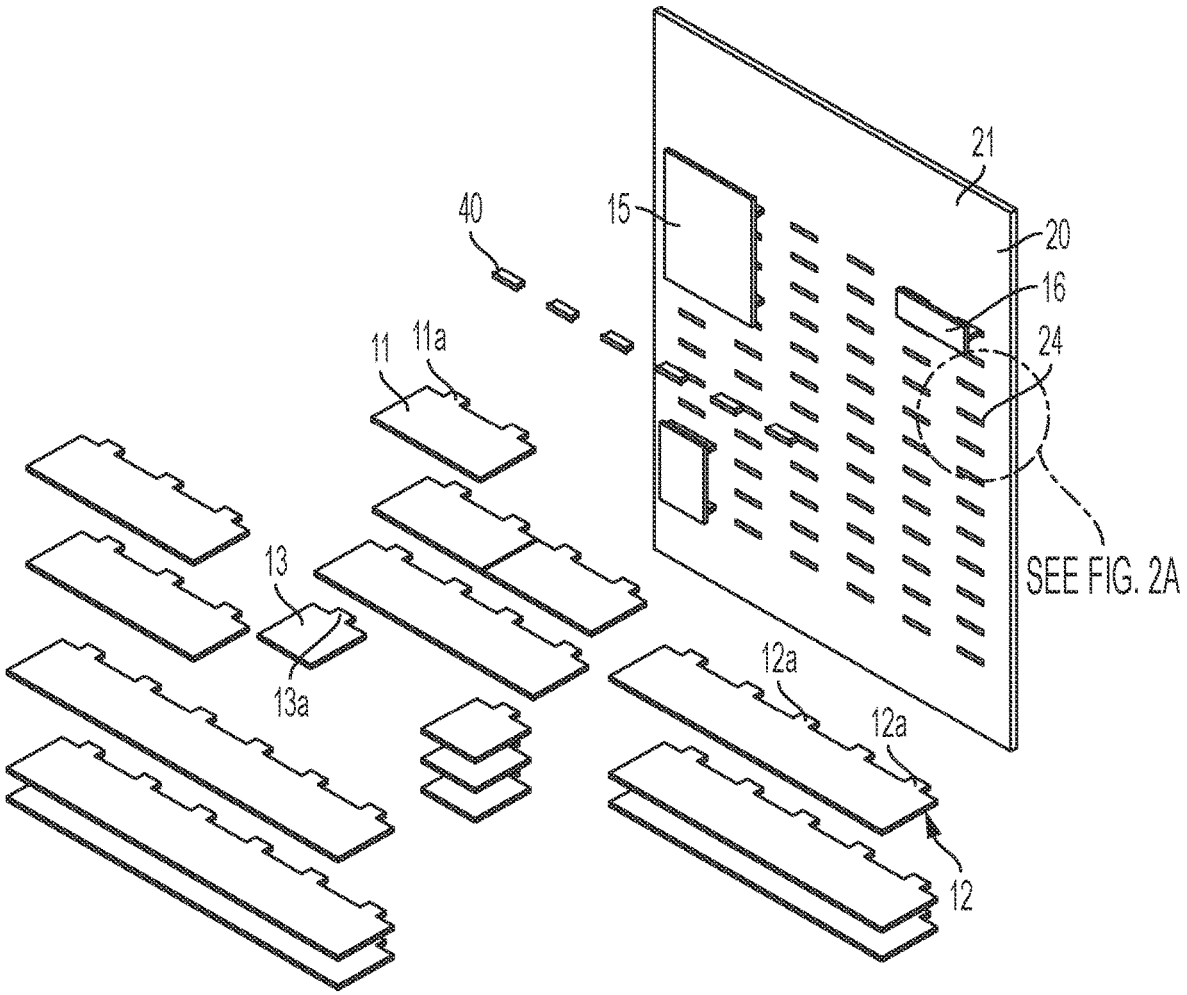
FIG. 2 is the view of FIG. 1 depicting the cantilevered members and a plurality of brackets exploded from the vertical panel.
Figure 2A:
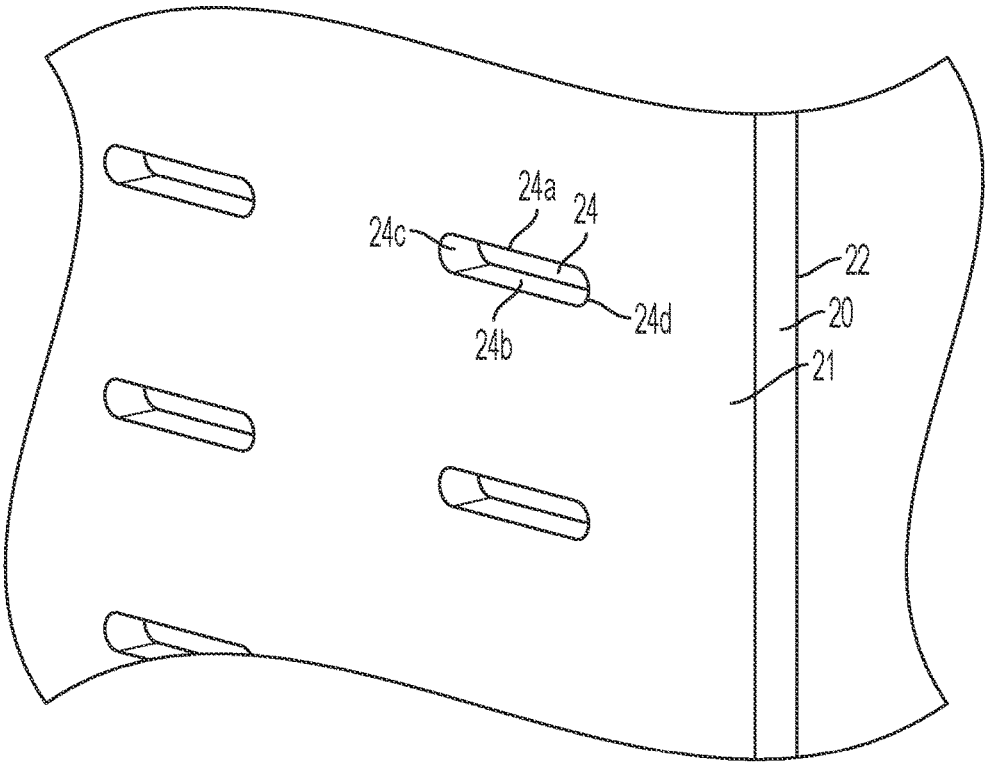
FIG. 2*a* is a view of detail Z of FIG. 2.
Figure 2B:
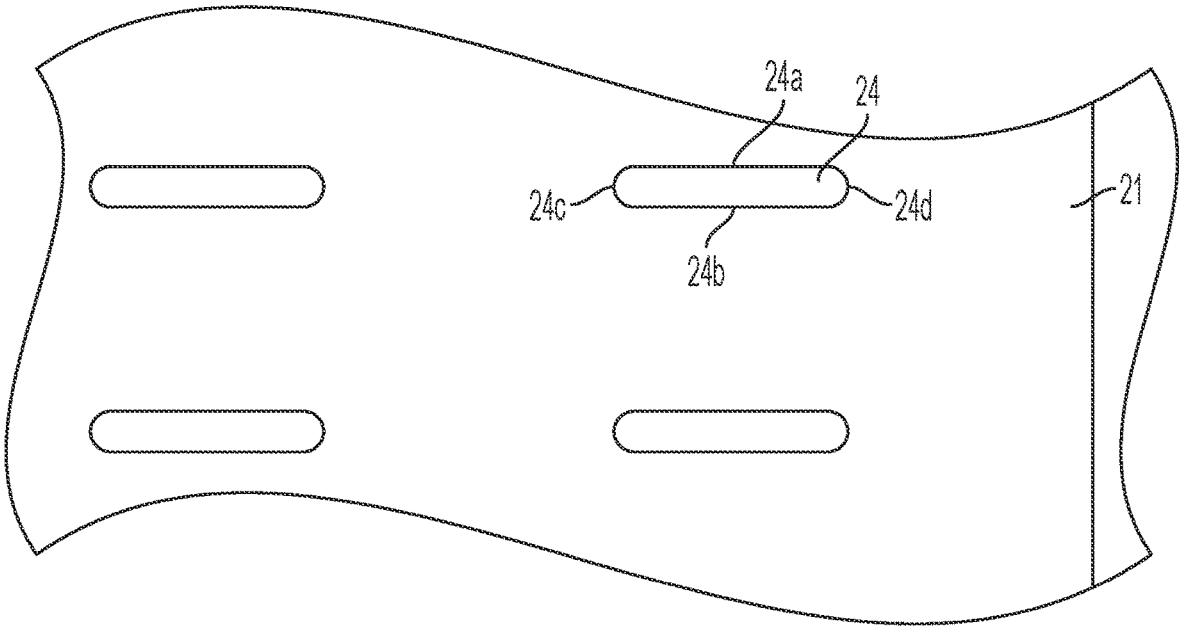
FIG. 2*b* is a front view of the view of FIG. 2.
Figure 9:
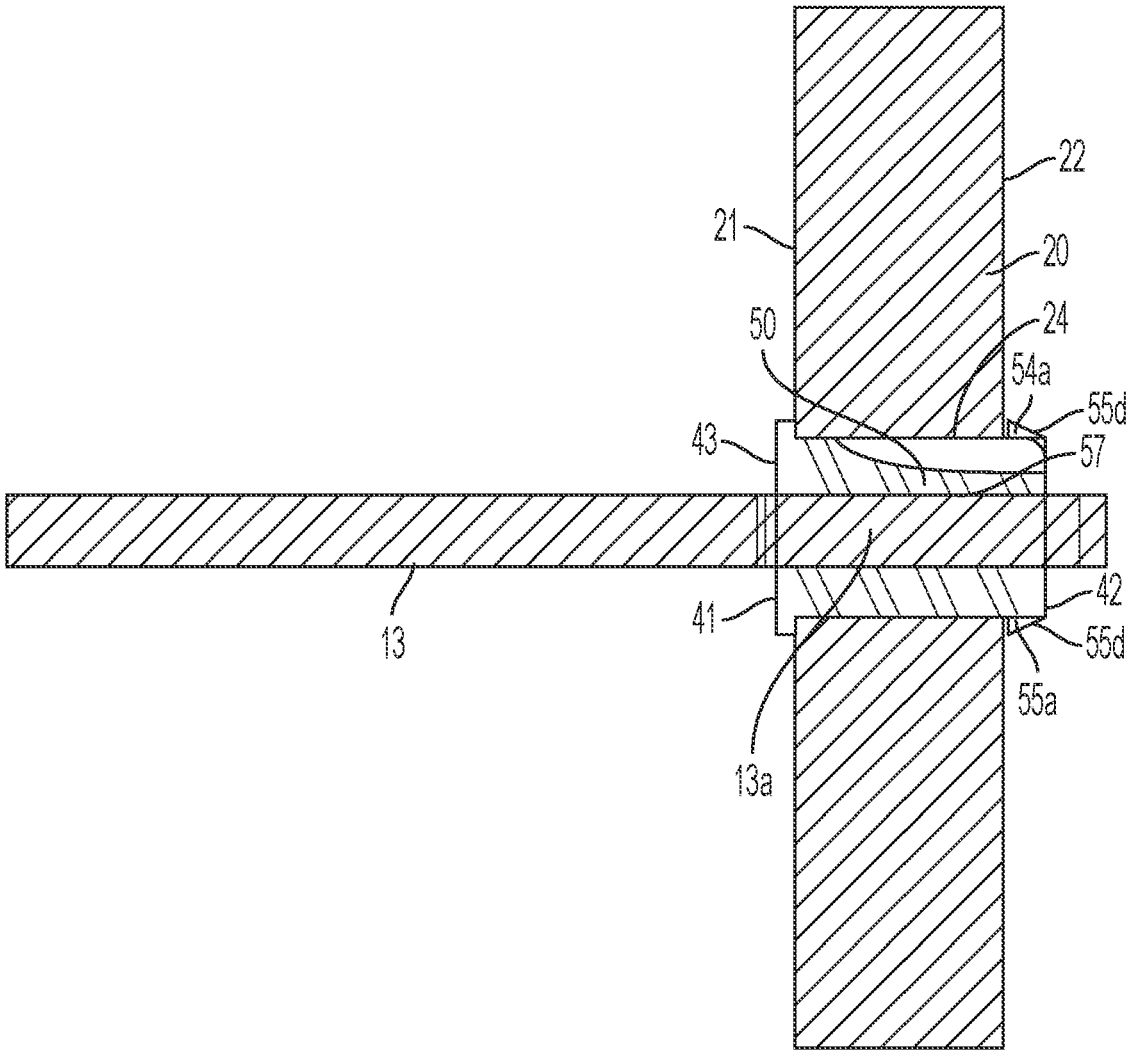
FIG. 9 is a side cross-sectional view of engage a tang of a flat shelf within the aperture of the bracket, with the bracket inserted within an aperture in the panel.

As best shown in FIG. 1, the system may include a panel or wall 20 that supports a plurality of shelves 11, 12, 13, and other items such as signs 16 or mirrors 15, or other fixed items that are disposed either in an orientation that is perpendicular to the wall 20 (as the shelves 11, 12, 13 are disposed) or parallel with the wall 20 (as the mirrors 15 and the sign 16) are disposed. In other embodiments, items may be disposed at an oblique angle with respect to the wall 20. The wall 20 includes a front surface 21 and an opposite rear surface 22, with the front surface normally being a display surface that is configured to be displayed outwardly such as for a customer in a facility that includes the system 10 to come into contact with and see, while the rear surface 22 is normally hidden from view of the customer in the facility. As best shown in FIGS. 2 and 9, the wall 20 may include a plurality of apertures 24 disposed therein, which are disposed to receive brackets 40 therein, which in turn receive a tang (e.g. 11*a*, 12*a*) that extends from the object (e.g. shelf, mirror, sign, or other object to be supported) to ultimately be supported by the wall 20.

The plurality of apertures 24 may be disposed in a geometric pattern such as arranged into a plurality of rows and columns, or in other embodiments, the plurality of apertures may be arranged into an arbitrary pattern, which is designed to position the objects into a visually pleasing arrangement and/or an arrangement that is intended to display and support the objects into a certain functional or optimal manner. As discussed elsewhere herein, in embodiments, where the objects are supported by more than one tang, the apertures 24 are arranged onto the wall to support that object in a desired orientation and position upon the wall 20. As shown in FIG. 2, some members to be supported by the panel include two, three, for or more tangs (12*a*, 11*a*) that are each received through different spaced apertures 24 within the panel 20, with the members normally approaching the panel 20 such that the different tangs 12*a*, 11*a* simultaneously are inserted within the apertures 24 as the member approaches the front surface 21 of the panel 20 and the apertures 24.

In some embodiments, the aperture 24 extends through the wall 20 from the front surface 21 to the rear surface 22. The aperture 24 may be different cross-sections, including a uniform cross-section along its length as well as a cross-section that varies along its length. One of ordinary skill in the art after a thorough review of this specification and figures will readily understand that the size and/or geometry of the aperture 24 will be driven by the geometry of the bracket 40, discussed below, as well as driven by the size another other components of the tang that will be received within the bracket 40 and the aperture 24. In some embodiments, all of the apertures 24 within a panel 20 will be the same size and geometry, while in embodiments, apertures within the same panel may have differing sizes and/or geometries based upon the objects intended for support at different positions upon the panel 20.

In the embodiments depicted within FIGS. 1-9, the apertures 24 have a consistent geometry along their length and extend from the front surface 21 to the rear surface 22 of the panel 20. The aperture 24 includes planar and parallel top and bottom walls 24*a*, 24*b* and arcuate left and right walls 24*c*, 24*d*. In other embodiments, the left and right walls could be planar such that the aperture is rectangular, or another geometric shape.

Figure 3:
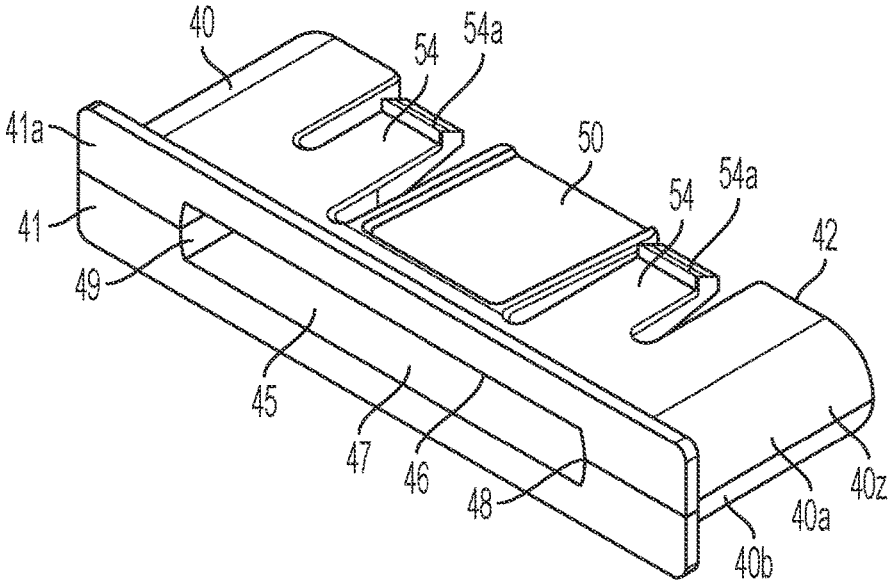
FIG. 3 is a front perspective view of the bracket of the system of FIG. 1.
Figure 4:
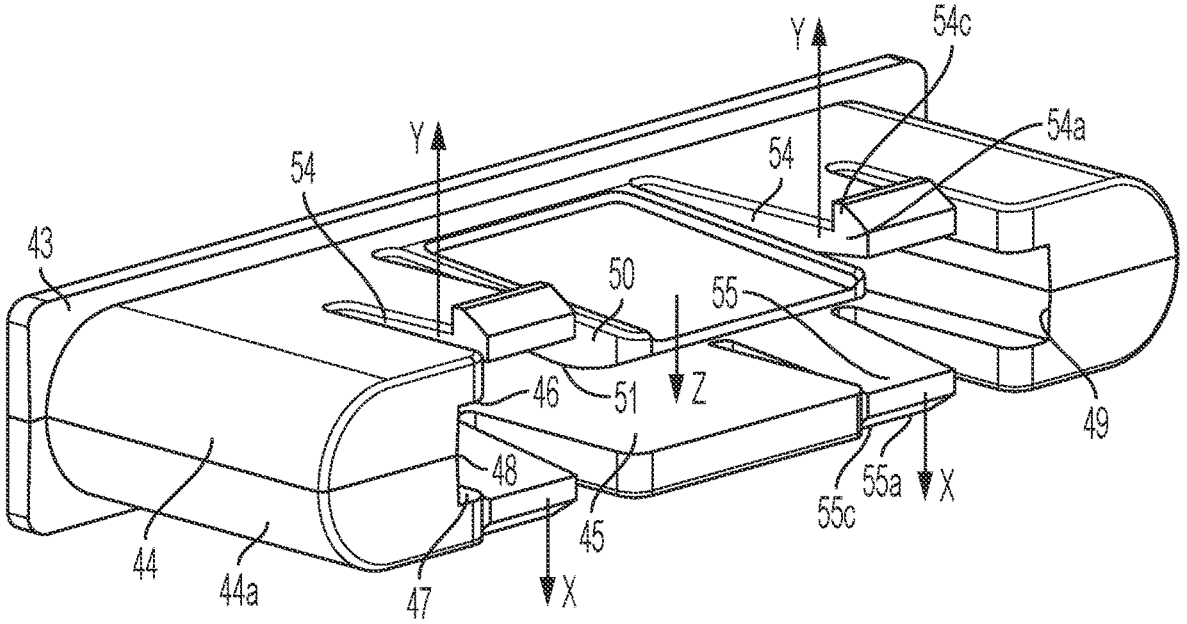
FIG. 4 is a rear perspective view of the bracket of FIG. 3.
Figure 5:
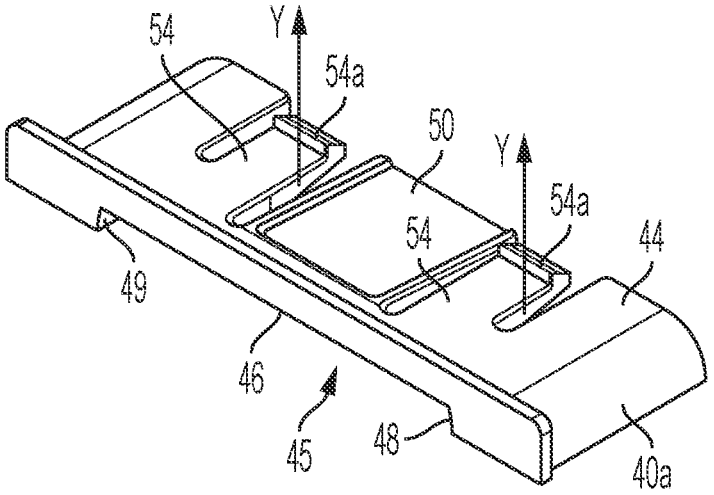
FIG. 5 is a perspective view of an upper portion of the bracket of FIG. 3.
Figure 6:
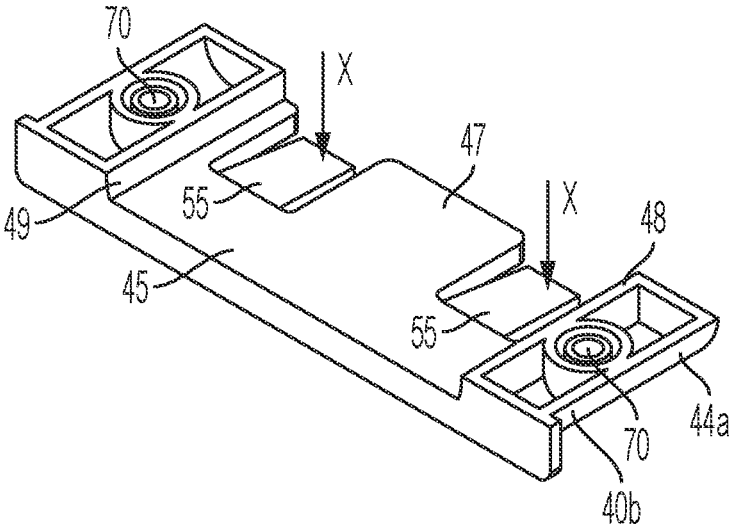
FIG. 6 is a perspective view of a lower portion of the bracket of FIG. 3.
Figure 7:
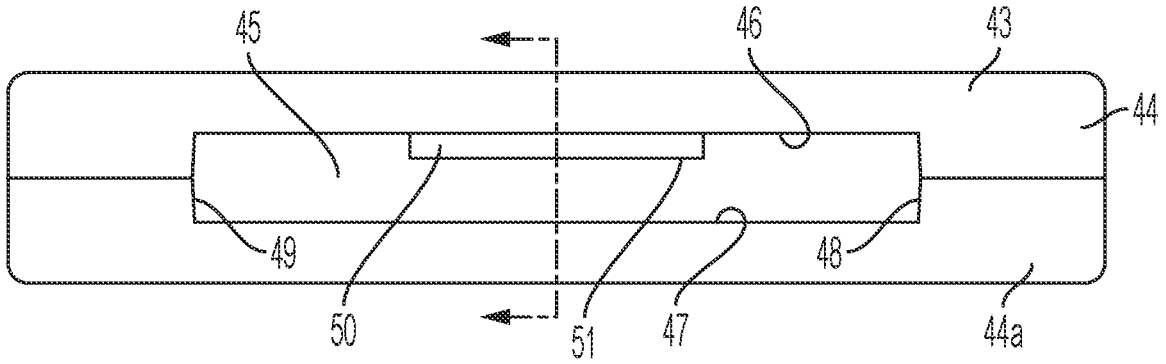
FIG. 7 is a front view of the bracket of FIG. 3.

As best shown in FIGS. 3-4, a bracket 40 is disposed within every aperture 24 that is intended to support a tang. A representative bracket is discussed herein and depicted in the figures, and possible modifications of the bracket 40 will be discussed herein. The bracket 40 is configured to extend into and through the aperture 24 and in some embodiments, extend fully through the aperture 24 so portions of the bracket 40 are disposed outside of the aperture and in contact with both the front and rear surfaces 21, 22 of the panel 20. In the embodiments described and depicted herein the bracket 40 is configured to extend into the aperture from the front surface 21 of the panel 20.

The bracket 40 may include a body 40*z* and includes a front portion 41 and a rear portion 42. The bracket 40 includes an aperture (or hole) 45 that extends through all or a portion of the bracket 40 and extends from a front surface 41*a* of the front portion 41. The aperture 45 is configured to receive a tang (e.g. 11*a*, 12*a*, 13*a*) of an object to be supported. The aperture 45 may extend through the entire bracket 40 while in other embodiments, the aperture 45 may blindly extend through the bracket 40 but not extend to an end surface of the rear portion 42. The aperture 45 defines a top surface 46, a bottom surface 47, a left surface 49, and a right surface 48. The aperture may have the same cross-sectional geometry and a size just larger than the cross-sectional geometry and size as the tang intended for receipt within the aperture 45 such that the tang can be easily slid into the aperture 45, with the aperture 45 supporting the tang to eliminate possible relative movement between the tang and the bracket 40 when the tang is fully inserted therein. In some embodiments the aperture 45 may be rectangular, while in other embodiments the aperture may be other geometries, such as with planer top and bottom surfaces 46, 47 but curved end surfaces 49, 48.

In some embodiments, the bracket 40 may be formed from a unitary member, while in other embodiments the bracket 40 may be formed from two pieces (40*a*, 40*b*) that are fixed together such as with a press fit connection, with pins and holes (holes 70 depicted in FIG. 6 with corresponding pins disposed upon the half of the bracket depicted in FIG. 5 but upon the opposite side of the half depicted in the figure to extend into the holes 70), or with fasteners.

Figure 8:
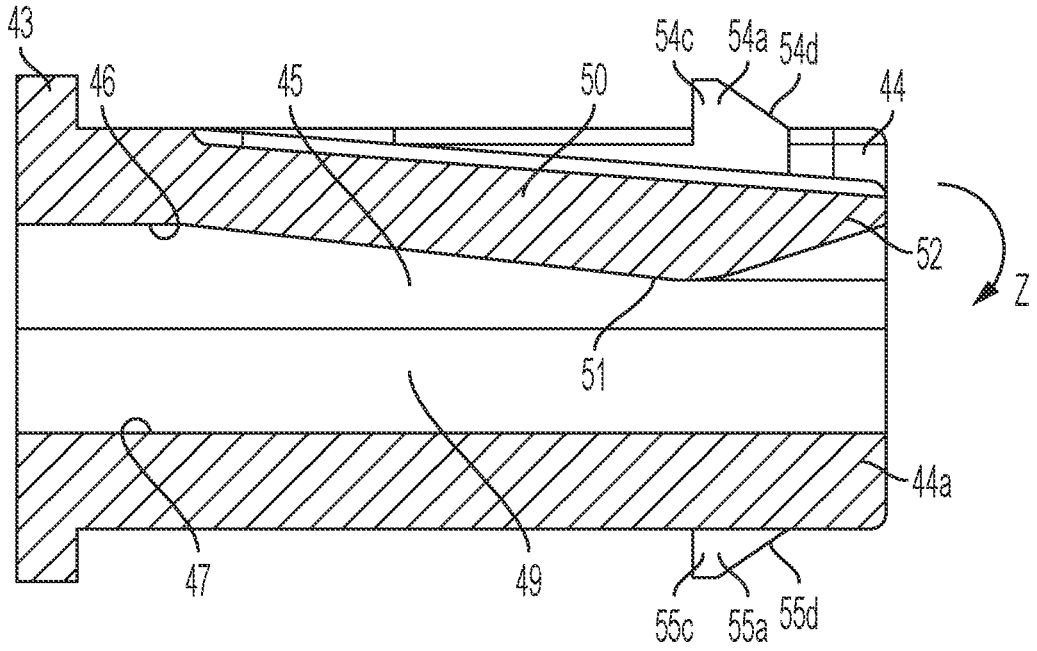
FIG. 8 is a side cross-sectional view of the bracket of FIG. 3.

The bracket 40 may include an arm 50 that extends from a portion of the bracket that defines the top surface 46 of the aperture 45 and is biased inwardly within a space defined by the aperture toward the bottom surface 47 (direction Z, FIG. 4). In other words, the collective top, bottom, left, and right surfaces 46, 47, 48, 49 define a geometry of the aperture 45, and the arm 50 is biased such that a portion of the arm 50 extends into the geometry of the aperture 45, as best depicted in FIGS. 4 and 8. In other embodiments, the arm 50 may extend from the portion of the bracket 40 that defines the bottom surface 47 of the aperture 40. The arm 50 may be supported by the body 40*z* of the bracket 40 and include an extended portion 52 that extends from the body but is not otherwise supported by the body 40*z*. The arm 50 is biased to extend into the geometry of the aperture 45 defined by the fixed portions of the various surfaces (46, 47, 48, 49) and may be urged away from the geometry of the aperture 45 by imparting a force upon the arm 50, such as by inserting a tang into the aperture 45, which contacts a bottom surface 51 of the arm 50 and pushes the arm 50 out of the geometry of the aperture 45 (as depicted in FIG. 9), with the biasing force upon the arm 50 urging the extended portion 52 toward the tang and therefore establishing a frictional force upon the surface of the tang that engages the arm 50.

In some embodiments, the arm 50 extends from the body 40*a* at a position that is spaced from the front portion 41 of the body, such that the tang from the object that is slid into the aperture 45 slides within the aperture 45 for a distance before contacting the arm 50 extending into the aperture 45.

The bracket 40 may further include one or more fingers 54, 55 that extend from the body 40*z* and are biased in a direction away from the aperture 45, such as in an upward direction Y (FIG. 5) for the one or more fingers 54 (when provided) that extend from an upper portion of the body 40*z* and a downward direction X (FIG. 6) for the one or more fingers 55 (when provided) that extend from a lower portion of the body 40*z*. The fingers 54, 55 may extend from the body in a cantilevered fashion, each including an extended end 54*a*, 55*a*. The fingers each include an upstanding portion 54*c*, 55*c*, which extends outside of the outer surfaces of the body 40*z* from which the finger extends, such as an upper surface of the body for fingers 54 and a lower surface of the body for fingers 55. The upstanding portions 54*c*, 55*c* may be sized such that the upstanding portions extend above the respective upper or lower surface of the body both in their normal biased outward configuration (FIG. 4) and in configuration when the bracket 40 extends through the aperture 24 in the panel 20 with the upstanding portions 54*c*, 55*c* of the fingers extending past the rear surface 22 of the panel 20 (FIG. 9).

The bracket 40 may include a flange 43 disposed upon the front portion 41 of the bracket 40 and in some embodiments the flange is flush with the front surface of the bracket 40. The flange extends radially outward from the surface forming the rear portion 42 of the body and extends a distance to allow the flange 43 when the bracket 40 is installed within the aperture 24 to contact the front surface 21 of the panel 20, such that no void of the aperture 24 is exposed when viewing the front surface 21 of the panel 20.

One of ordinary skill in the art with a review of this specification and figures will understand that when the bracket 40 is installed within an aperture (FIG. 9) the bracket 40 is prevented from being pulled out of the aperture 40 in either direction, i.e. through the front surface 21 or through the rear surface 22. The bracket 40 is prevented from being pulled out from the front surface 21 due to the engagement with the upstanding portions 54*c*, 55*c* of the fingers and the rear surface 22 of the panel, and the bracket 40 is prevented from being pulled out from the rear surface 22 due to the engagement between the flange 43 and the front surface 21 of the panel 20.

The fingers 54, 55 are sufficiently flexibly disposed upon the body 40*z* such that the fingers 54, 55 may be pushed inwardly into the aperture 45 as the bracket 40 approaches the aperture 24 upon the panel 20 to allow the body 40*z* to slide into and through the aperture. The fingers 54, 55 may include a ramped or chamfered surface 54*d*, 55*d* that are positioned to be aligned with the upper and lower edges of the aperture 24 upon the panel, and the engagement between the chamfered surfaces 54*d*, 55*d* and the edges (and the force applied to the bracket 40 to push the bracket 40 in the aperture 24) causes the fingers to be pushed inwardly due to a vertical component of the force upon the fingers 54, 55 from the edges of the aperture. The inward motion of the fingers causes the upstanding portions 54*c*, 55*c* to clear within the aperture 24, and therefore the bracket 40 can be pushed through the aperture 24. When the upstanding portions 54*c*, 55*c* clear the aperture, they extend outwardly due to the biasing force inherent in the fingers such that the upstanding portions are aligned with the rear surface 22 of the panel 20 as discussed above. The bracket 40 can be removed from the panel 20 once installed by compressing the two fingers 54, 55 together (such as with a user's fingers or with pliers) to compress the fingers into the aperture 45 until the fingers clear the edges of the aperture 24 in the panel with the rear wall—which allows the bracket 40 to be pulled out of the panel in a leftward direction in the view of FIG. 9.

As discussed above, the object to be supported by the panel 20 (such as a shelf, a mirror, as sign or the like) may include a tang that extends from the object along a plane and is configured to extend within the aperture 45 within the bracket 40, as best shown in FIG. 9. The tang (e.g. 13*a* in FIG. 9 in an embodiment where the object is a horizontal shelf) may be the same shape and a size just smaller than the shape and size of the aperture 45 within the bracket 40 so that the tang fits snugly with in the aperture 45 but can be easily inserted into and slid along the aperture 45. The tang includes an upper or lower surface that is engaged by the arm 50, as the tang is slid into the aperture 45, and the biasing force of the arm 50 upon the tang establishes a frictional force that provides resistance to the tang being pulled out of the aperture 45.

Figure 10:
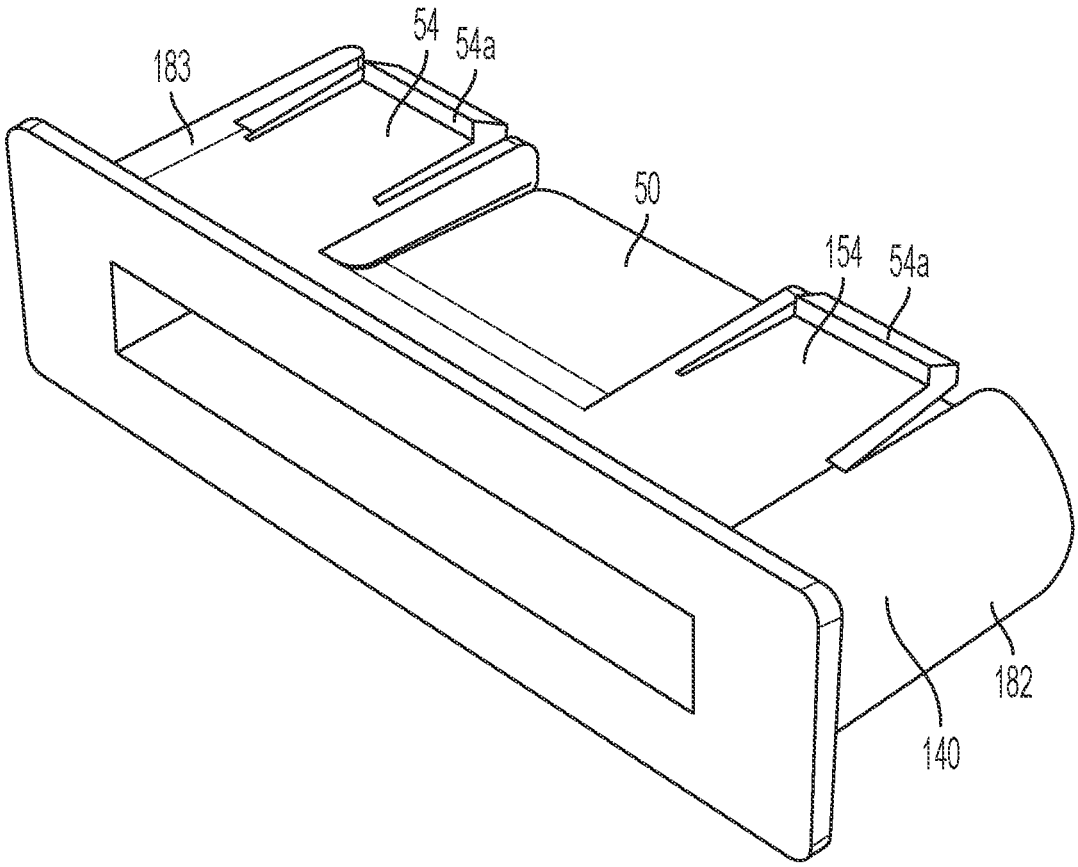
FIG. 10 is a front perspective view of an alternate bracket usable with the system of FIG. 1.
Figure 10A:
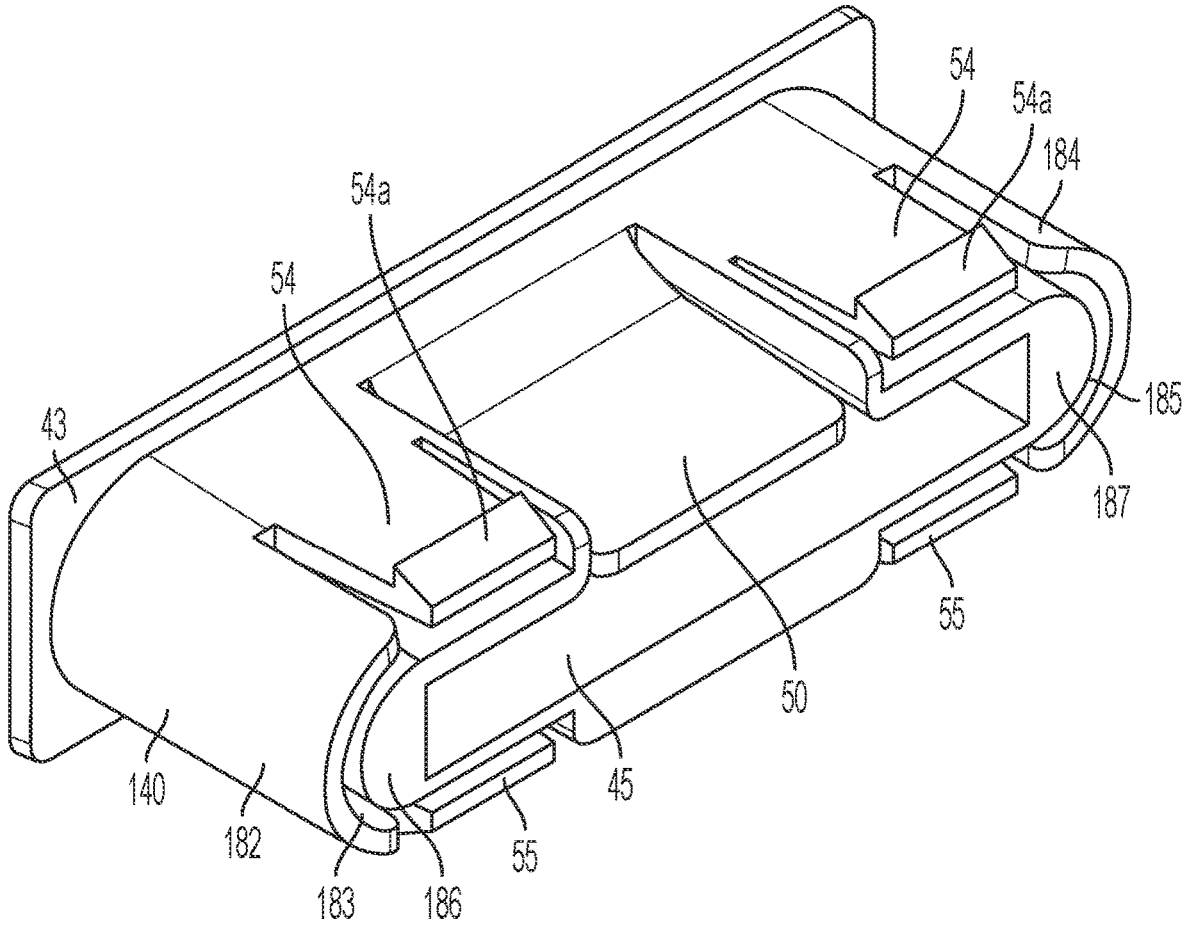
FIG. 10*a* a rear perspective view of the bracket of FIG. 10.

In some embodiments, as depicted in FIGS. 10 and 10*a*, an alternate bracket 140 is provided. The bracket 140 is installed and released from the aperture 24 in the panel 24 in the same manner as the bracket 40 discussed above, and components of the bracket 140 that are the same as components of the bracket 40 are depicted with like element numbers and will be configured and operate as those components are discussed above. The bracket 140 may include right and left wings 182, 184 that define the respective right and left outer surfaces of the bracket 140, which engage the respective right and left portions 24*d*, 24*a* of the aperture 24 on the panel 20. The right and left wings 182, 184 extend from the front portion 41 of the bracket 140 and establish a space 183, 185 between the wing and the neighboring portions of the body 186, 187 (which establish the respective right and left walls of the aperture 45 in the bracket 140. The wings and spaces allow the bracket 140 to have some play once installed within the aperture 24 in the panel to allow for easy installation and once installed tight connections between the bracket 140 and the panel 20. In some embodiments, the right and left wings 182, 184 may be arcuate in embodiments where the aperture 24 in the panel has arcuate ends, while in other embodiments, the wings may be different shapes that are complimentary to the ends of the aperture 24 in the panel 10.

In some embodiments, alternative brackets may be formed that do not include an aperture that extends through the front surface at the front portion 41 of the bracket, but instead the flange forms a planar surface across the entire front surface. This type of bracket may be used as a filler for apertures 24 in the panel where no objects are intended to be inserted and are not otherwise visually covered by other components of the system 10. This alternative bracket will provide an aesthetically pleasing component to cover the aperture in the panel 24 that might otherwise be visible upon the panel 20. This alternative bracket may include the fingers 54, 55 discussed above with respect to bracket 40 to allow the bracket to be removably attached to the panel 20.

While the preferred embodiments of the disclosed have been described, it should be understood that the invention is not so limited and modifications may be made without departing from the disclosure. The scope of the disclosure is defined by the appended claims, and all devices that come within the meaning of the claims, either literally or by equivalence, are intended to be embraced therein.

The invention claimed is:

1. A system to support a member extending from a wall, comprising:

a wall with one or more apertures disposed therethrough;

a bracket configured to be disposed within an aperture of the one or more apertures, the bracket comprising a front portion and a rear portion; and a member comprising a tang and a portion that extends from the tang, wherein the tang is configured to extend within and be supported by the bracket;

the bracket comprises a body with a hole disposed through a front surface of the front portion of the body, the hole receives the tang therein, the hole being formed with a length and a width just larger than a respective length and a respective width of the tang, wherein the hole extends through the entire bracket; wherein the body comprises a plurality of surfaces including opposite upper and lower surfaces, and opposite left and right surfaces that collectively define the body, wherein at least one of the upper surface, the lower surface, the left surface, and the right surface comprises a portion biased inwardly toward the respective opposite surface of the plurality of surfaces, wherein the biased portion extends inwardly past an inner surface of the respective surface of the plurality of surfaces that includes the biased portion;

the body further comprises a plurality of fingers that extend from the plurality of walls, the plurality of fingers each biased in a direction away from the hole.

2. The system to support a member extending from a wall of claim 1, wherein the biased portion is movable such that the biased portion can be urged away from a position extending inwardly past the inner surface of the respective wall of the plurality of walls that includes the biased portion by the tang being inserted into the hole from the front surface of the bracket, wherein the biased portion applies a force onto a surface of the tang in contact with an inward surface of the biasing member.

3. The system to support a member extending from a wall of claim 1, wherein the biased portion extends from the respective wall of the plurality of walls a distance away from a front portion of the bracket such that the tang can be inserted into the hole through the front surface of the bracket and be extended into the hole a distance before the tang engages the biased portion.

4. The system to support a member extending from a wall of claim 1, wherein the member is a flat member that extends along a consistent plane as the tang.

5. The system to support a member extending from a wall of claim 1, wherein the member includes a vertical member where the tang extends from the vertical member at a perpendicular or at an oblique angle with respect to one or more surfaces of the vertical member.

6. The system to support a member extending from a wall of claim 1, wherein the member extends across a plurality of apertures upon the wall and the member includes a respective plurality of tangs that extend therefrom and are aligned to simultaneously extend within the plurality of apertures as the member approaches a front surface of the wall.

7. The system to support a member extending from a wall of claim 1, wherein each of the plurality of fingers comprise an upstanding portion that extends outwardly from an outer surface of the body proximate to the respective plurality of fingers.

8. The system to support a member extending from a wall of claim 7, wherein each of the plurality of fingers includes a ramp portion disposed upon the upstanding portion, wherein when the bracket approaches and is aligned with an aperture in the wall, the ramp surfaces of the plurality of fingers engage a panel edge defining the respective aperture, which with continued motion of the bracket into the respective aperture the panel edge applies a vertical force to the plurality of fingers which pushes each of the plurality of fingers in a direction toward the hole, until a top edge of each ramp surface is positioned within a volume defined by the respective aperture in the wall thereby allowing the bracket to be slid into and through the respective aperture in the wall.

9. The system to support a member extending from a wall of claim 8, wherein the bracket is deeper than a depth of the wall, and wherein when the bracket is slid through the respective aperture in the wall the upstanding portion of each respective finger clears the aperture and moves in the direction away from the hole.

10. The system to support a member extending from a wall of claim 9, wherein the front portion of the bracket comprises a flange that extends radially outward past an outer circumference of a remaining front portion of the bracket, wherein when installed, the flange contacts a front face of the wall and the upstanding portion of the plurality of fingers contact an opposite rear face of the wall.

11. The system to support a member extending from a wall of claim 1, wherein right and left side portions of the body comprise an outer member and an inner member, with a space disposed between the outer member and an inner member.

12. The system to support a member extending from a wall of claim 11, wherein the outer member can be urged inwardly toward the inner member to decrease the space therebetween if a radially inward force is applied upon the outer member.

13. The system to support a member extending from a wall of claim 1, wherein the member extends from the tang and from the wall in a cantilevered manner.

14. The system to support a member extending from a wall of claim 1, wherein a portion of the member contacts or is supported by the wall at a location remote from a position where the tang is supported by the bracket.

15. A system to support a member extending from a wall, comprising:

a wall with one or more apertures disposed therethrough;

a bracket configured to be disposed within an aperture of the one or more apertures, the bracket comprising a front portion and a rear portion; and a member comprising a tang and a portion that extends from the tang, wherein the tang is configured to extend within and be supported by the bracket, the bracket comprises a body with a hole disposed through a front surface of the front portion of the body, the hole receives the tang therein, the hole being formed with a length and a width just larger than a respective length and a respective width of the tang, wherein the hole extends blindly within the bracket from the front surface of the body, wherein the body comprises a plurality of surfaces including opposite upper and lower surfaces, and opposite left and right surfaces that collectively define the hole, wherein at least one of the upper surface or the lower surface comprises an arm biased inwardly toward the opposite surface of the upper or lower surfaces, wherein the arm extends inwardly past an inner surface of the respective surface that includes the arm;

the body further comprises a plurality of fingers that extend from one or more of the upper and lower surfaces of the plurality of surfaces, the plurality of fingers each biased in a direction away from the hole.

16. The system to support a member extending from a wall of claim 15, wherein the arm is movable such that the arm can be urged away from a position extending inwardly past the inner surface of the respective surface that includes the arm by the tang being inserted into the hole from the front surface of the bracket, wherein the arm applies a force onto a surface of the tang in contact with an inward surface of the arm.

17. The system to support a member extending from a wall of claim 15, wherein the arm extends from the respective surface a distance away from a front portion of the bracket such that the tang can be inserted into the hole through the front surface of the bracket and be extended into the hole a distance before the tang engages the arm.

18. The system to support a member extending from a wall of claim 15, wherein the member is a flat member that extends along a consistent plane as the tang.

19. The system to support a member extending from a wall of claim 15, wherein the member includes a vertical member where the tang extends from the vertical member at a perpendicular or at an oblique angle with respect to one or more surfaces of the vertical member.

20. The system to support a member extending from a wall of claim 15, wherein the member extends across a plurality of apertures upon the wall and the member includes a respective plurality of tangs that extend therefrom and are aligned to simultaneously extend within the plurality of apertures as the member approaches a front surface of the wall.

21. The system to support a member extending from a wall of claim 15, wherein each of the plurality of fingers comprise an upstanding portion that extends outwardly from an outer surface of the body proximate to the respective plurality of fingers.

22. The system to support a member extending from a wall of claim 21, wherein each of the plurality of fingers includes a ramp portion disposed upon the upstanding portion, wherein when the bracket approaches and is aligned with an aperture in the wall, the ramp surfaces of the plurality of fingers engage a panel edge defining the respective aperture, which with continued motion of the bracket into the respective aperture the panel edge applies a vertical force to the plurality of fingers which pushes each of the plurality of fingers in a direction toward the hole, until a top edge of each ramp surface is positioned within a volume defined by the respective aperture in the wall thereby allowing the bracket to be slid into and through the respective aperture in the wall.

23. The system to support a member extending from a wall of claim 22, wherein the bracket is deeper than a depth of the wall, and wherein when the bracket is slid through the respective aperture in the wall the upstanding portion of each respective finger clears the aperture and moves in the direction away from the hole.

24. The system to support a member extending from a wall of claim 23, wherein the front portion of the bracket comprises a flange that extends radially outward past an outer circumference of a remaining front portion of the bracket, wherein when the bracket is installed in the wall, the flange contacts a front face of the wall and the upstanding portion of the plurality of fingers contact an opposite rear face of the wall.

25. The system to support a member extending from a wall of claim 15, wherein right and left side portions of the body comprise an outer member and an inner member, with a space disposed between the outer member and the inner member.

26. The system to support a member extending from a wall of claim 25, wherein the outer member can be urged inwardly toward the inner member to decrease the space therebetween if a radially inward force is applied upon the outer member.

27. The system to support a member extending from a wall of claim 15, wherein the member extends from the tang and from the wall in a cantilevered manner.

28. The system to support a member extending from a wall of claim 15, wherein a portion of the member contacts or is supported by the wall at a location remote from a position where the tang is supported by the bracket.

* * * * *